US008986071B2

(12) United States Patent
White, Jr.

(10) Patent No.: US 8,986,071 B2
(45) Date of Patent: Mar. 24, 2015

(54) PARTS CARRIER ASSEMBLY FOR GRINDING MACHINE

(75) Inventor: Hollis N. White, Jr., Hopkinsville, KY (US)

(73) Assignee: White Drive Products, Inc., Hopkinsville, KY (US)

( * ) Notice: Subject to any disclaimer, the term of this patent is extended or adjusted under 35 U.S.C. 154(b) by 610 days.

(21) Appl. No.: 13/312,191

(22) Filed: Dec. 6, 2011

(65) Prior Publication Data

US 2013/0143472 A1 Jun. 6, 2013

(51) Int. Cl.

| | |
|---|---|
| ***B24B 37/08*** | (2012.01) |
| ***B24B 37/28*** | (2012.01) |
| ***B24B 41/06*** | (2012.01) |

(52) U.S. Cl.

CPC ..... *B24B 37/28* (2013.01); *B24B 41/067* (2013.01)

USPC ..... 451/41; 451/57; 451/63; 451/267; 451/271; 451/282; 451/287; 451/291; 451/398; 451/400

(58) Field of Classification Search

USPC ..... 451/41, 56, 57, 63, 267, 268, 269, 270, 451/271, 282, 285, 287, 288, 291, 397, 398, 451/400, 443, 444

See application file for complete search history.

(56) References Cited

U.S. PATENT DOCUMENTS

| | | | | |
|---|---|---|---|---|
| 3,813,828 | A | 6/1974 | Bennett | |
| 3,925,936 | A * | 12/1975 | Orlov et al. | 451/269 |
| 4,617,762 | A | 10/1986 | Hoglund | |
| 5,938,506 | A * | 8/1999 | Fruitman et al. | 451/41 |
| 6,145,849 | A | 11/2000 | Bae et al. | |
| 6,206,765 | B1 * | 3/2001 | Sanders et al. | 451/56 |
| 6,296,554 | B1 * | 10/2001 | Lai et al. | 451/271 |
| 6,338,672 | B1 * | 1/2002 | White | 451/443 |
| 7,589,023 | B2 | 9/2009 | Taniguchi et al. | |
| 2002/0077046 | A1 | 6/2002 | Nanjo et al. | |

OTHER PUBLICATIONS

International Search Report and Written Opinion dated Jul. 6, 2012 for PCT Application No. PCT/US12/35949.

* cited by examiner

*Primary Examiner* — Eileen Morgan

(74) *Attorney, Agent, or Firm* — Rankin, Hill & Clark LLP

(57) ABSTRACT

A parts carrier assembly for a grinding machine includes an annular parts carrier and a bearing insert. The annular parts carrier includes an upper surface, a lower surface, an inner edge, an outer edge, and a plurality of loading apertures. The inner edge is configured to engage a driving wheel of the grinding machine. The driving wheel rotates about a central axis resulting in rotation of the parts carrier about an offset axis, which is offset from the central axis. The loading apertures are configured to receive parts to be ground by the grinding machine. The bearing insert includes an inner bearing surface complementary in shape to the outer edge of the parts carrier. The outer surface the parts carrier bears against the inner bearing surface of the bearing insert as the parts carrier rotates about the offset axis.

15 Claims, 2 Drawing Sheets

PARTS CARRIER ASSEMBLY FOR GRINDING MACHINE

BACKGROUND

Grinding machines are used to flatten surfaces of machine parts. In a known grinding machine, a parts carrier is located between two grinding wheels, i.e., an upper grinding wheel having an upper planer grinding surface and a lower grinding wheel having a lower planer grinding surface. The known parts carrier assembly consists of a fixed outer ring, a driven inner pinion, and toothed planet wheels all located between the upper grinding surface and the lower grinding surface of the respective grinding wheels. The parts to be ground are located in sockets found in the toothed planet wheels.

Such a grinding machine provides adequate results; however, loading and unloading of the grinding machine can require a significant amount of time because the plurality of toothed planet wheels that must be loaded into and unloaded from the grinding machine.

SUMMARY

In view of the foregoing, a parts carrier assembly for a grinding machine is provided. The parts carrier assembly includes an annular parts carrier and a bearing insert. The annular parts carrier includes an upper surface, a lower surface, an inner edge, an outer edge, and a plurality of loading apertures. The loading apertures extend though the parts carrier from the upper surface to the lower surface. The inner edge is configured to engage a driving wheel of the grinding machine. The driving wheel of the grinding machine rotates about a central axis resulting in rotation of the parts carrier about an offset axis, which is offset from the central axis. The loading apertures are configured to receive associated parts to be ground by the grinding machine. The bearing insert includes an inner bearing surface complementary in shape to the outer edge of the parts carrier. The outer surface the parts carrier bears against the inner bearing surface of the bearing insert as the parts carrier rotates about the offset axis.

The parts carrier assembly can be provided in combination with the grinding machine. The grinding machine includes an upper grinding wheeling having an upper substantially planar grinding surface, a lower grinding wheel having a lower substantially planar grinding surface, the driving wheel which is axially interposed between the upper grinding wheel and the lower grinding wheel, and an outer fixed ring axially interposed between the upper grinding wheel and the lower grinding wheel.

A method for loading parts to be ground into a grinding machine is also provided. The grinding machine is similar to that described in the previous paragraph. The method includes loading a plurality of parts to be ground into respective loading apertures found in an annular parts carrier. The method further includes operatively connecting the parts carrier with the driving wheel such that the parts carrier and the plurality of parts to be ground are axially disposed between the upper grinding wheel and the lower grinding wheel. The method further includes rotating the driving wheel about the central axis resulting in rotation of the parts carrier about an offset axis, which is offset from the central axis.

A method for grinding parts is also provided. The method includes loading a plurality of parts that are to be ground into a parts carrier. The method further includes rotating a grinding wheel including a substantially planar grinding surface about a central axis. The grinding surface has an outer diameter $od_1$. The method further includes rotating the parts carrier having an outer diameter $od_2$, which is greater than $od_1/2$, about an offset axis, which is offset from the central axis. The method further includes contacting the grinding surface of the rotating grinding wheel with the parts that have been loaded into the parts carrier.

DETAILED DESCRIPTION

Figure 1:
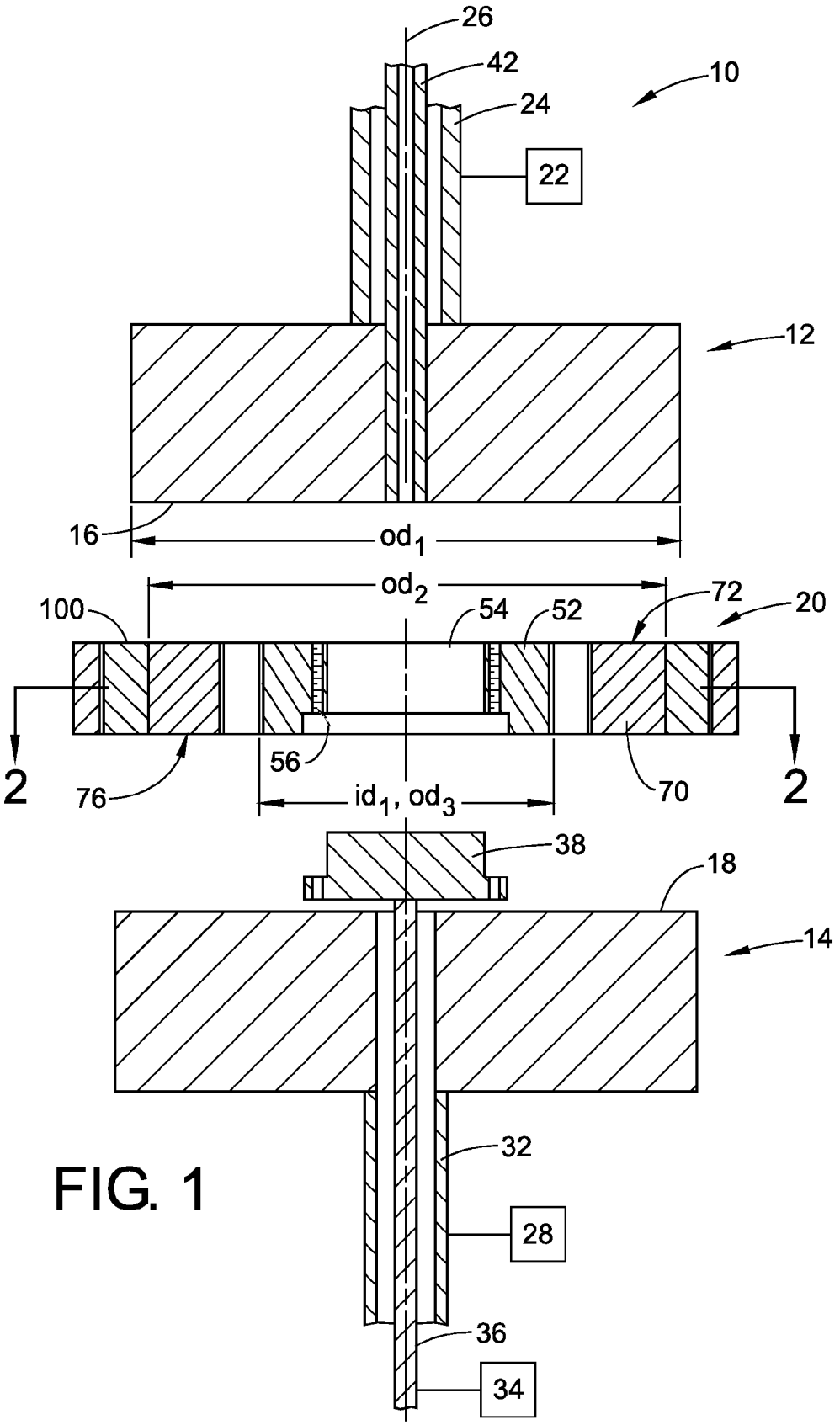
FIG. 1 is a schematic cross-sectional side view of a grinding machine.

The description and drawings herein are merely illustrative and are provided so that one of ordinary skill in the art can make and use a grinding machine and a parts carrier assembly described herein. Various modifications and alterations can be made in the structures and steps disclosed without departing from the scope of the invention, which is defined by the appended claims. Various identified components of a grinding machine disclosed herein are merely terms of art that may vary from one manufacturer to another. The terms should not be deemed to limit the invention. The drawings are shown for purposes of illustrating one or more exemplary embodiments and are not for purposes of limiting the appended claims. All references to direction and position, unless otherwise indicated, refer to the orientation of the components illustrated in the drawings and are not to be construed as limiting the appended claims.

FIG. 1 schematically depicts a grinding machine 10 that includes an upper grinding wheel 12 and a lower grinding wheel 14. The upper grinding wheel 12 includes an upper substantially planar grinding surface 16. The lower grinding wheel 14 includes a lower substantially planar grinding surface 18. The grinding surfaces 16, 18 are used to flatten machine parts that are loaded into a parts carrier assembly 20 located between the grinding surfaces.

In the illustrated embodiment, each grinding surface 16, 18 has an outer diameter $od_1$ and an inner diameter $id_1$. Each grinding surface 16, 18 includes grinding particles such as cubic-boron-nitride (CBN) particles embedded in each respective grinding wheel 12, 14 between the outer diameter $od_1$ and the inner diameter $id_1$. In this embodiment, the CBN particles are suspended in a plastic carrier located at the planar grinding wheel surface 16, 18 of each respective wheel 12, 14. Other grinding particles and other carriers for grinding particles may be employed.

A first motor 22 operatively connects with a first drive shaft 24 to rotate the upper grinding wheel 12 about a central axis 26. A second motor 28 operatively connects with a second drive shaft 32 to rotate the lower grinding wheel 14 about the central axis 26. A third motor 34 can operatively connect with a drive gear shaft 36 to rotate a drive pinion 38 about the central axis 26. The drive pinion 38 drives the parts carrier assembly 20 in the grinding machine 10 in a manner that will be described in more detail below. During a grinding operation coolant fluid can be fed into the grinding machine 10 through a fluid conduit 42.

Figure 2:
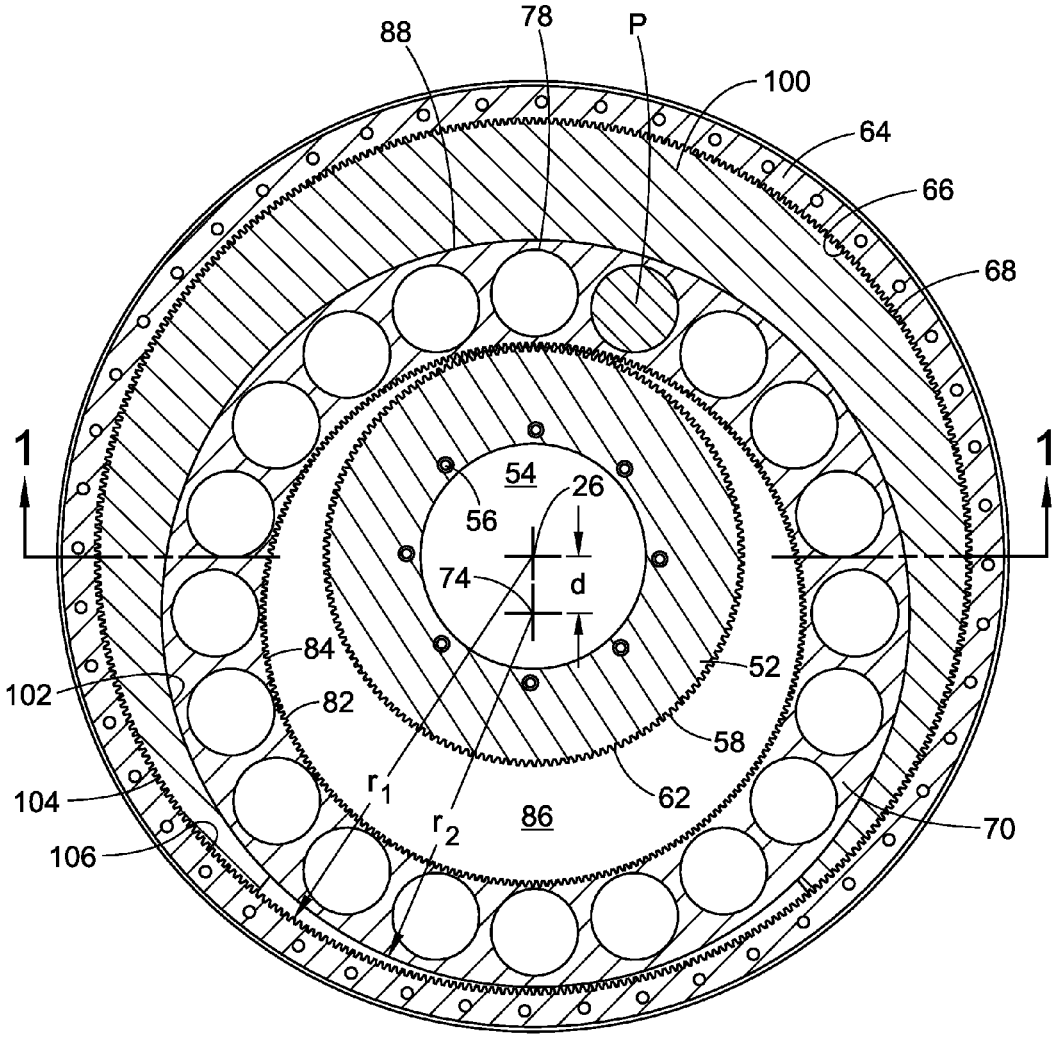
FIG. 2 is a cross-sectional view of a parts carrier assembly used to carry parts to be ground by grinding machine shown in FIG. 1.

The grinding machine 10 also includes a driving wheel 52, which is configured to be driven by the drive pinion 38. The driving wheel 52 includes a central opening 54 and a plurality of bolt holes 56 to facilitate attachment of the driving wheel 52 to the drive pinion 38. In the illustrated embodiment, the driving wheel 52 is a circular gear that rotates about the central axis 26. With reference to FIG. 2, the driving wheel 52 includes an outer circumferential surface 58, which in the illustrated embodiment includes a plurality of gear teeth, referred to herein as driving wheel gear teeth 62.

The grinding machine 10 further includes an outer ring 64 having an interior circumferential edge 66. A plurality of outer ring teeth 68 on the interior circumferential edge 66 extend inwardly toward the central axis 26. The interior circumferential edge 66 of the outer ring 64 is offset from the central axis 26 a radius $r_1$.

With reference back to FIG. 1, the parts carrier assembly 20 is disposed in the grinding machine 10 axially between the upper grinding surface 16 of the upper grinding wheel 12 and the lower grinding surface 18 of the lower grinding wheel 14 during a grinding operation. The parts carrier assembly 20 includes an annular parts carrier 70 and a bearing insert 100. Parts P (only one part P is depicted in FIG. 2) that are to be ground are loaded into the annular parts carrier 70 and the parts P are contacted by the upper grinding surface 16 of the rotating upper grinding wheel 12 and the lower grinding surface 18 of the rotating lower grinding wheel 14 to flatten the parts.

With reference back to FIG. 1, the annular parts carrier 70 includes an upper surface 72 disposed generally normal to an offset axis 74, which will be described below, and a lower surface 76 that is disposed generally normal to the offset axis 74. An annular parts carrier height is defined between the upper surface 72 and the lower surface 76 measured parallel to the offset axis 74. The annular parts carrier 70 also includes a plurality of loading apertures 78 extending through the parts carrier from the upper surface 72 to the lower surface 76. The loading apertures 78 are depicted as circular (see FIG. 2) in the illustrated embodiment; however, the loading apertures can take an alternative configuration based on the size and shape of the parts P that are to be ground by the grinding machine 10. The thickness (measured parallel to the offset axis 74) of the parts P that are to be loaded into the loading apertures 78 should at least be equal to, and preferably slightly greater than, the annular parts carrier height, which allows the parts to contact the upper grinding surface 16 of the upper grinding wheel 12 and the lower grinding surface 18 of the lower grinding wheel 14 during a grinding operation.

The annular parts carrier 70 engages with the driving wheel 52. The annular parts carrier 70 includes an inner edge 82 that includes a plurality of teeth, referred to herein as parts carrier teeth 84. The parts carrier teeth 84 on the inner edge 82 of the annular parts carrier 70 engage the driving wheel gear teeth 62 on the outer circumferential surface 58 of the driving wheel 52. In the embodiment depicted in FIG. 2, the parts carrier teeth 84 engage the driving wheel gear teeth 62 near a 12 o'clock position on the annular parts carrier 70 and the driving wheel 52 (per the orientation shown in FIG. 2). Rotation of the driving wheel 52 about the central axis 26 results in rotation of the annular parts carrier 70 about the offset axis 74, which is offset from and parallel to the central axis 26. As seen in FIG. 1, the central axis 26 is offset from the offset axis 74 a distance d.

As illustrated in FIG. 2, the annular parts carrier 70 surrounds the driving wheel 52. The annular parts carrier 70 and the driving wheel 52, which is a circular gear, define a crescent-shaped void 86 between the inner edge 82 of the annular parts carrier 70 and the outer circumferential surface 58 of the driving wheel 52. The annular parts carrier 70 further includes an outer edge 88, which acts as a bearing surface acting against the bearing insert 100. The outer edge 88 of the annular parts carrier 70 is offset from the offset axis 74 a radius $r_2$. The radius $r_1$ of the interior circumferential surface 66 of the outer ring 64 is substantially equal to $r_2$ (the radius to the outer edge 88 of annular parts carrier 70)+distance d, which is the distance that the central axis 26 is offset from the offset axis 74.

The parts carrier assembly 20 further includes the bearing insert 100. The bearing insert 100 is substantially crescent-shaped when viewed normal to the central axis 26. The bearing insert 100 can be made from an ultra high weight polyethylene material. The bearing insert 100 includes an inner substantially circular bearing surface 102 and an outer substantially circular surface 104. The inner substantially circular bearing surface 102 of the bearing insert 100 is complementary in shape to and bears against the outer edge 88 of the annular parts carrier 70 as the annular parts carrier rotates about the offset axis 74. The inner bearing surface 102 of the bearing insert 100 follows the radius $r_2$ with respect to the offset axis 74 and the outer substantially circular surface 104 follows the radius $r_1$ with respect to the central axis 26. Since the central axis 26 is offset from the offset axis 74 and because of the configuration of the outer ring 64, the inner bearing surface 102 does not make up a complete circle. As shown in FIG. 2, the bearing insert 100 is positioned between the annular parts carrier 70 and the outer ring 64. The inner diameter $2r_1$ of the outer ring, is substantially equal to the outer diameter $od_1$ of the planar grinding surfaces 16, 18 of the respective grinding wheels 12, 14.

The outer substantially circular surface 104 of the bearing insert 100 includes a plurality of bearing insert teeth 106. The outer substantially circular surface 104 of the bearing insert 100 engages with the outer ring 64 to fix the bearing insert 100 with respect to the outer ring 64. The bearing insert teeth 106 engage with the outer ring teeth 66. Although the bearing insert 100 is described as having the outer substantially circular surface 104, the outer surface 104 is non-circular and is configured to engage the fixed, non-rotating, outer ring 64 of the grinding machine 10 to preclude rotation of the bearing insert 100 with respect to the outer ring.

During a grinding operation, the grinding wheels 12, 14 are rotated about the central axis 26. Also during the grinding operation, when the grinding wheels 12, 14 rotate about the central axis 26, the annular parts carrier 70 rotates about the offset axis 74, which is offset from the central axis 26. While the annular parts carrier 70 rotates, the rotating grinding wheels 16, 18 are in contact with the parts P loaded into the respective loading apertures 78 of the rotating annular parts carrier 70. As mentioned above, each grinding wheel surface 16, 18 has an outer diameter $od_1$. The annular parts carrier 70 has an outer diameter $od_2$ (or $2r_2$), which is greater than $od_1/2$.

The outer diameter $od_1$ of the grinding surfaces 16, 18 of the respective grinding wheels 12, 14 is substantially equal to the diameter of the interior circumferential surface 104 of the outer ring 64 ($od_1=2r_1$). An outermost edge of the annular parts carrier 70 (shown as the 6 o'clock position in FIG. 2) nearly comes into contact with the interior circumferential surface 104 of the outer ring 64. As such, rotation of the annular parts carrier 70 results in movement of a respective part (among the plurality of parts that are to be ground by the grinding machine 10) from adjacent the inner diameter $id_1$ of the upper grinding surface 16 or the lower grinding surface 18 to adjacent the outer diameter $od_1$ of the upper grinding surface or the lower grinding surface.

The driving wheel 52 has an outer diameter $od_3$ that is substantially equal to the inner diameter $id_1$. The difference in the diameter of the driving wheel 52 and the diameter of the annular parts carrier 70, along with the axes 26, 74 being offset, results in the crescent-shaped gap 86 between the inner circumferential edge 82 of the annular parts carrier 70 and the outer circumferential surface 58 of the driving wheel 52. Particles removed from the parts that are being ground can fall into this crescent-shaped gap 86 and then be removed via the conduit 42 providing cleaning fluid into the grinding machine 10.

A method for loading parts to be ground into a grinding machine, such as the grinding machine 10 shown in FIG. 1, will now be described. As mentioned above, the grinding machine 10 includes an upper grinding wheel 12 having an upper substantially planar grinding surface 16, a lower grinding wheel 14 having a lower substantially planar grinding surface 18, the driving wheel 56 axially interposed between the upper grinding wheel 12 and the lower grinding wheel 14, and the outer fixed ring 64 axially interposed between the upper grinding wheel 12 and the lower grinding wheel 14. The upper grinding wheel 12, the lower grinding wheel 14, and the driving wheel 56 each rotate about the central axis 26. The method further includes loading a plurality of parts P to be ground into the respective loading apertures 78 found in the annular parts carrier 70. The method further includes operatively connecting the parts carrier 70 with the driving wheel 56 such that the parts carrier and the plurality of parts P to be ground are axially disposed between the upper grinding wheel 12 and the lower grinding wheel 14. The method further includes rotating the driving wheel 56 about the central axis 26 resulting in rotation of the parts carrier 70 about the offset axis 74, which is offset from the central axis 26. The method can further include positioning the bearing insert 100 between the parts carrier 70 and the outer fixed ring 64. The method can further include fixing the bearing insert 100 to the outer fixed ring 64 to inhibit rotation of the bearing insert with respect to the outer fixed ring.

A method for grinding parts will be described with reference to the grinding machine 10 shown in FIG. 1; however, the method can be used with other grinding machines. The method includes loading a plurality of parts P that are to be ground into the annular parts carrier 70 that surrounds the central axis 26. The method further includes rotating a grinding wheel (the upper grinding wheel 12 or the lower grinding wheel 14) including a substantially planar grinding surface 16, 18 about the central axis 26. Each grinding surface 16, 18 has an $od_1$. The method further includes rotating the parts carrier 70 having an $od_2$, which is greater than $od_1/2$, about the offset axis 74, which is offset from the central axis 26. The method further includes contacting the grinding surface 16, 18 of the rotating grinding wheel 12, 14 with the parts P that have been loaded into the annular parts carrier 70. Rotating the annular parts carrier 70 can further include rotating the parts carrier with the driving wheel 56 rotating about the central axis 26 and having the outer diameter $od_3$ substantially equal to the $id_1$. The method further includes providing the crescent-shaped gap 86 between the inner edge 82 of the parts carrier 70 and an outer circumferential surface 58 of the driving wheel 52. The method can further include positioning the bearing insert 100 between the parts carrier 70 and the outer ring 64. As mentioned above, the inner diameter of the outer ring 64 is substantially equal to $od_1$. As mentioned above, the bearing insert 100 and the outer ring 64 are fixed together and do not rotate.

A parts carrier assembly for a grinding machine, the parts carrier assembly in combination with the grinding machine, a method for loading parts to be ground into a grinding machine, and a method for grinding parts have been described above with particularity. Modifications and alterations will occur to those upon reading and understanding the preceding detailed description. The invention, however, is not limited to only the embodiments described above. Instead, the invention is broadly defined by the appended claims and the equivalents thereof.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A parts carrier assembly for a grinding machine, the parts carrier assembly comprising:

an annular parts carrier including an upper surface, a lower surface, an inner edge, an outer edge and a plurality of loading apertures extending through the parts carrier from the upper surface to the lower surface, wherein the inner edge is configured to engage a driving wheel of the grinding machine rotating about a central axis resulting in rotation of the parts carrier about an offset axis, which is offset from the central axis, wherein the loading apertures are configured to receive associated parts to be ground by the grinding machine; and a bearing insert having an inner bearing surface complementary in shape to the outer edge of the parts carrier, wherein the outer surface of the parts carrier bears against the inner bearing surface of the bearing insert as the parts carrier rotates about the offset axis, wherein the bearing insert is substantially crescent shaped when viewed normal to the central axis.

2. The parts carrier assembly of claim 1, wherein the bearing insert includes a non-circular outer surface configured to engage a fixed, non-rotating, outer ring of the grinding machine.

3. The parts carrier assembly of claim 2, wherein the bearing insert includes a plurality of teeth formed along the outer surface.

4. The parts carrier assembly of claim 1, wherein the inner edge of the parts carrier includes a plurality of gear teeth for engaging the driving wheel.

5. The parts carrier assembly of claim 1, wherein the central axis is offset a distance d from the offset axis, wherein a peripheral edge of the bearing insert is spaced a radius $r_1$ from the central axis, wherein the outer edge of the parts carrier is spaced a radius $r_2$ from the offset axis, wherein $r_2+d$ is substantially equal to $r_1$.

6. A parts carrier assembly in combination with a grinding machine, the parts carrier assembly including an annular parts carrier including an upper surface, a lower surface, an inner edge, an outer edge and a plurality of loading apertures extending through the parts carrier from the upper surface to the lower surface, wherein the inner edge is configured to engage a driving wheel of the grinding machine rotating about a central axis resulting in rotation of the parts carrier about an offset axis, which is offset from the central axis, wherein the loading apertures are configured to receive associated parts to be ground by the grinding machine; and a bearing insert having an inner bearing surface complementary in shape to the outer edge of the parts carrier, wherein the outer surface of the parts carrier bears against the inner bearing surface of the bearing insert as the parts carrier rotates about the offset axis, wherein the bearing insert is substantially crescent shaped when viewed normal to the central axis, the grinding machine including an upper grinding wheel having an upper substantially planar grinding surface, a lower grinding wheel having a lower substantially planar grinding surface, the driving wheel which is axially interposed between the upper grinding wheel and the lower grinding wheel, and an outer fixed ring axially each interposed between the upper grinding wheel and the lower grinding wheel, wherein the bearing insert is fixed to the outer fixed ring to inhibit rotation of the bearing insert with respect to the outer fixed ring.

7. The combination of claim 6, wherein the central axis is offset a distance d from the offset axis, wherein an interior circumferential edge of the outer fixed ring is spaced a radius $r_1$ from the central axis, wherein the outer edge of the parts carrier is spaced a radius $r_2$ from the offset axis, wherein $r_2+d$ is substantially equal to $r_1$.

8. The combination of claim 7, wherein the upper planar grinding surface and the lower planar grinding surface each have matching inner diameters $id_1$ and matching outer diameters $od_1$, wherein each $od_1$ is substantially equal to $2r_1$.

9. The combination of claim 8, wherein the driving wheel engages the parts carrier, wherein the driving wheel has an outer diameter $od_e$, which is substantially equal to $od_1$.

10. The combination of claim 6, wherein the parts carrier surrounds the driving wheel.

11. The combination of claim 10, wherein the bearing insert is substantially crescent shaped when viewed normal to the central axis and a crescent shaped void is provided between the driving wheel and the parts carrier when the inner edge of the parts carrier is connected with the driving wheel.

12. A method for grinding parts comprising:

loading a plurality of parts that are to be ground into an annular parts carrier that surrounds a central axis;

rotating a grinding wheel including a substantially planar grinding surface about the central axis, the grinding surface having an outer diameter $od_1$;

rotating the parts carrier having an outer diameter $od_2$, which is greater than $od_1/2$, about an offset axis, which is offset from the central axis; positioning a bearing insert between the parts carrier and an outer ring, wherein an inner diameter of the outer ring is substantially equal to od1, and wherein the bearing insert is substantially crescent shaped when viewed normal to the central axis; and contacting the grinding surface of the rotating grinding wheel with the parts that have been loaded into the parts carrier.

13. The method of claim 12, wherein the substantially planar grinding wheel surface has an inner diameter $id_1$, wherein rotating the parts carrier further includes rotating the parts carrier with a driving wheel rotating about the central axis and having an outer diameter $od_3$ substantially equal to the inner diameter $id_1$.

14. The method of claim 12, further comprising providing a crescent-shaped gap between an inner edge of the parts carrier and an outer circumferential surface of the driving wheel.

15. The method of claim 12, wherein the bearing insert and the outer ring are fixed together and do not rotate.

* * * * *

UNITED STATES PATENT AND TRADEMARK OFFICE

CERTIFICATE OF CORRECTION

PATENT NO. : 8,986,071 B2
APPLICATION NO. : 13/312191
DATED : March 24, 2015
INVENTOR(S) : Hollis N. White, Jr.

It is certified that error appears in the above-identified patent and that said Letters Patent is hereby corrected as shown below:

IN THE CLAIMS

In Column 8, line 14, change "od1" to -- $od_1$ --

Signed and Sealed this
Twenty-seventh Day of October, 2015

Michelle K. Lee

Michelle K. Lee
*Director of the United States Patent and Trademark Office*